US011001992B2

(12) United States Patent
Morimoto

(10) Patent No.: US 11,001,992 B2
(45) Date of Patent: May 11, 2021

(54) SHOVEL, DISPLAY METHOD, AND MOBILE TERMINAL

(71) Applicant: SUMITOMO(S.H.I.) CONSTRUCTION MACHINERY CO., LTD., Tokyo (JP)

(72) Inventor: Takaaki Morimoto, Chiba (JP)

(73) Assignee: SUMITOMO(S.H.I.) CONSTRUCTION MACHINERY CO., LTD., Tokyo (JP)

( * ) Notice: Subject to any disclaimer, the term of this patent is extended or adjusted under 35 U.S.C. 154(b) by 0 days.

(21) Appl. No.: 16/358,952

(22) Filed: Mar. 20, 2019

(65) Prior Publication Data

US 2019/0218753 A1 Jul. 18, 2019

Related U.S. Application Data

(63) Continuation of application No. PCT/JP2017/035145, filed on Sep. 28, 2017.

(30) Foreign Application Priority Data

Sep. 29, 2016 (JP) ..... JP2016-192229

(51) Int. Cl.
*E02F 9/26* (2006.01)
*E02F 3/43* (2006.01)
*E02F 3/34* (2006.01)

(52) U.S. Cl.
CPC ..... *E02F 9/26* (2013.01); *E02F 3/34* (2013.01); *E02F 3/431* (2013.01)

(58) Field of Classification Search
CPC ..... E02F 9/26; E02F 3/431; E02F 3/34
See application file for complete search history.

(56) References Cited

U.S. PATENT DOCUMENTS

2002/0046048 A1 4/2002 Fukushima et al.
2006/0092033 A1* 5/2006 Hoff ..... E02F 9/20 340/679
2006/0200283 A1* 9/2006 Furuno ..... B66C 13/16 701/29.6
2008/0270074 A1 10/2008 Horkavi et al.
2011/0227744 A1 9/2011 Shibata et al.
2013/0158797 A1* 6/2013 Fukano ..... E02F 9/264 701/36

(Continued)

FOREIGN PATENT DOCUMENTS

JP 2002-023831 1/2002
JP 2010-273344 12/2010

(Continued)

OTHER PUBLICATIONS

International Search Report for PCT/JP2017/035145 dated Dec. 19, 2017.

*Primary Examiner* — Donald J Wallace
(74) *Attorney, Agent, or Firm* — IPUSA, PLLC

(57) ABSTRACT

A shovel includes a lower traveling body, an upper turning body turnably mounted on the lower traveling body, a cab mounted on the upper turning body, an attachment including a working part configured to perform work, and a display device provided in the cab. The display device is configured to display information related to the time of the last adjustment of the information of the working part.

16 Claims, 10 Drawing Sheets

(56) References Cited

U.S. PATENT DOCUMENTS

| | | | | |
|---|---|---|---|---|
| 2014/0257647 | A1* | 9/2014 | Wu | E02F 9/24 701/50 |
| 2015/0112544 | A1* | 4/2015 | Tsukamoto | E02F 9/267 701/33.2 |
| 2016/0024757 | A1* | 1/2016 | Nomura | E02F 3/435 414/687 |
| 2017/0021769 | A1 | 1/2017 | Izumikawa et al. | |
| 2017/0275854 | A1 | 9/2017 | Izumikawa | |
| 2018/0002899 | A1 | 1/2018 | Morimoto | |
| 2018/0089823 | A1* | 3/2018 | Carpenter | G07C 5/006 |
| 2019/0338497 | A1* | 11/2019 | Espejo Pina | E02F 9/267 |

FOREIGN PATENT DOCUMENTS

| | | |
|---|---|---|
| WO | 2010/073771 | 7/2010 |
| WO | 2015/077735 | 5/2015 |
| WO | 2015/163382 | 10/2015 |
| WO | 2016/098741 | 6/2016 |
| WO | 2016/148251 | 9/2016 |

* cited by examiner

SHOVEL, DISPLAY METHOD, AND MOBILE TERMINAL

CROSS-REFERENCE TO RELATED APPLICATIONS

This application is a continuation application filed under 35 U.S.C. 111 (a) claiming benefit under 35 U.S.C. 120 and 365 (c) of PCT International Application No. PCT/JP2017/035145, filed on Sep. 28, 2017 and designating the U.S., which claims priority to Japanese patent application No. 2016-192229, filed on Sep. 29, 2016. The entire contents of the foregoing applications are incorporated herein by reference.

BACKGROUND

Technical Field

The present invention relates to shovels, display methods, and mobile terminals.

Description of Related Art

An operator who operates a shovel serving as a construction machine is required to have expert operational skills to efficiently and accurately perform work such as excavation with an attachment. That being so, a shovel that has a function of guiding shovel operations (hereinafter referred to as "machine guidance function") to allow less experienced shovel operators to accurately perform work is known.

Among shovels with the machine guidance function, shovels that can provide accurate machine guidance, even in the case where a bucket tooth is worn by work such as excavation, by calculating the amount of wear of and making adjustments to the worn bucket tooth are known.

SUMMARY

According to an aspect of the present invention, a shovel includes a lower traveling body, an upper turning body turnably mounted on the lower traveling body, a cab mounted on the upper turning body, an attachment including a working part configured to perform work, and a display device provided in the cab. The display device is configured to display information related to the time of the last adjustment of the information of the working part.

DETAILED DESCRIPTION

Figure 1:
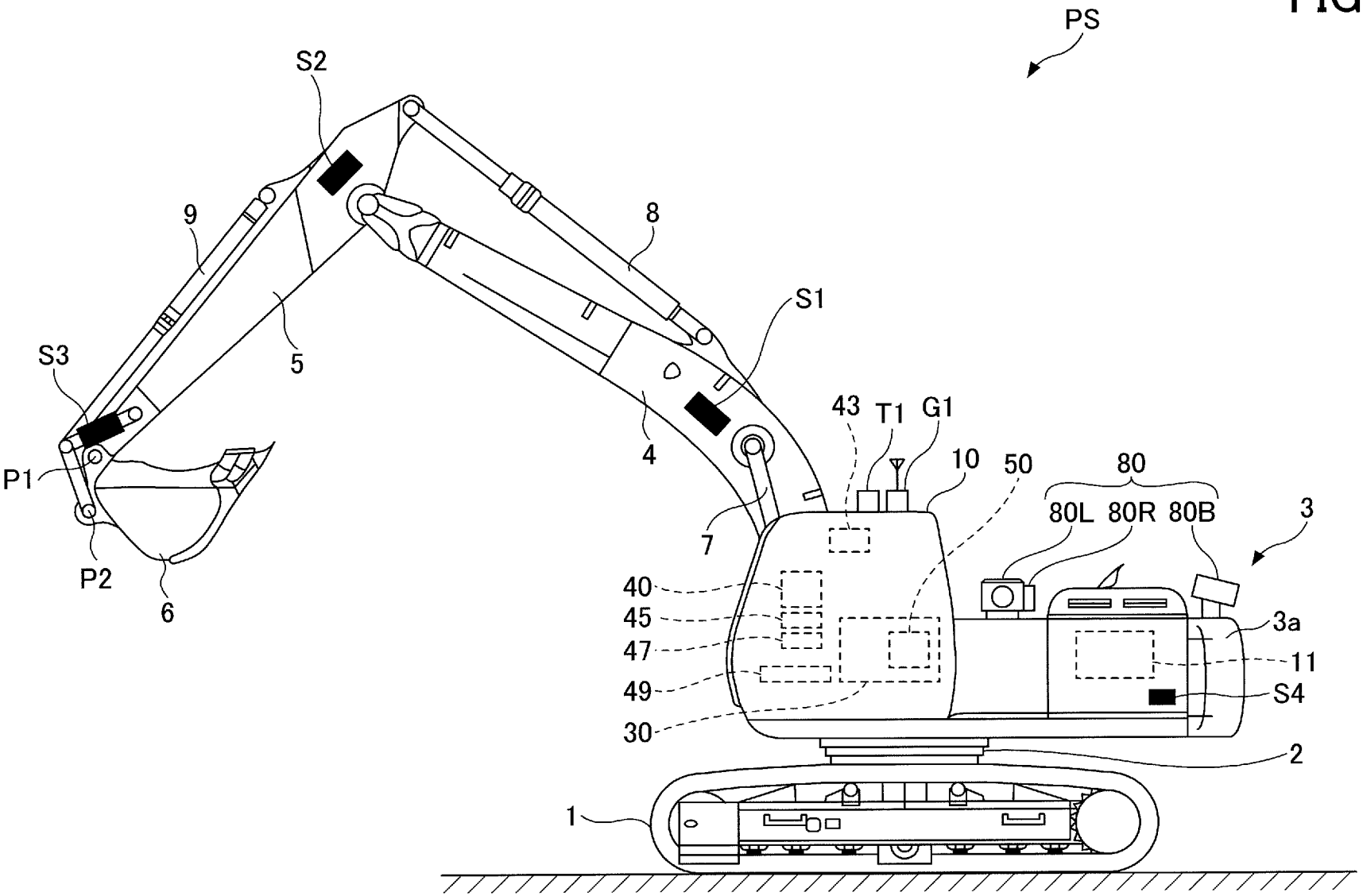
FIG. 1 is a side view illustrating a shovel according to an embodiment.

According to the above-described technique, however, for example, after passage of time since the adjustment of the bucket (tooth), it is not easy to determine when the bucket currently used was adjusted. Therefore, an operator may adjust the bucket when it is not necessary to make adjustments or may perform work such as excavation without making adjustments when it is necessary to make adjustments.

When the operator adjusts the bucket when it is not necessary to make adjustments, man-hours increase. When the operator performs work such as excavation without making adjustments when it is necessary to make adjustments, the work such as excavation cannot be performed with accuracy.

According to an embodiment of the present invention, a shovel that causes a bucket to be adjusted at an appropriate time is provided.

An embodiment of the invention is described below with reference to the drawings. In the drawings, the same constituent parts are given the same reference numeral, and duplicate description thereof may be omitted.

FIG. 1 is a side view illustrating a shovel PS according to the embodiment.

An upper turning body 3 is turnably mounted on a lower traveling body 1 of the shovel PS via a turning mechanism 2. A boom 4 is attached to the upper turning body 3. An arm 5 is attached to the end of the boom 4. A bucket 6 is attached to the end of the arm 5 with an arm top pin P1 and a bucket link pin P2 as an end attachment (a working part). A slope bucket, a dredging bucket, a breaker or the like may alternatively be attached as an end attachment.

The boom 4, the arm 5, and the bucket 6 form an excavation attachment as an example of an attachment, and are hydraulically driven by a boom cylinder 7, an arm cylinder 8, and a bucket cylinder 9, respectively. A boom angle sensor S1 is attached to the boom 4. An arm angle sensor S2 is attached to the arm 5. A bucket angle sensor S3 is attached to the bucket 6. A bucket tilt mechanism may be provided on the excavation attachment. The boom angle sensor S1, the arm angle sensor S2, and the bucket angle sensor S3 may be referred to as "posture sensors."

The boom angle sensor S1 detects the rotation angle of the boom 4. For example, the boom angle sensor S1 is an acceleration sensor that detects the rotation angle of the boom 4 relative to the upper turning body 3 by detecting an inclination to a horizontal plane.

The arm angle sensor S2 detects the rotation angle of the arm 5. For example, the arm angle sensor S2 is an acceleration sensor that detects the rotation angle of the arm 5 relative to the boom 4 by detecting an inclination to a horizontal plane.

The bucket angle sensor S3 detects the rotation angle of the bucket 6. For example, the bucket angle sensor S3 is an acceleration sensor that detects the rotation angle of the bucket 6 relative to the arm 5 by detecting an inclination to a horizontal plane.

When the excavation attachment is provided with a bucket tilt mechanism, the bucket angle sensor S3 additionally detects the rotation angle of the bucket 6 about a tilt axis. The boom angle sensor S1, the arm angle sensor S2, and the bucket angle sensor S3 may alternatively be potentiometers using a variable resistor, stroke sensors that detect the stroke amount of a corresponding hydraulic cylinder, or rotary encoders that detect a rotation angle about a link.

Power sources such as an engine 11 and a body tilt sensor S4 are mounted on the upper turning body 3 and covered with a cover 3*a*. The body tilt sensor S4 detects the tilt angle of the upper turning body 3. For example, the body tilt sensor S4 is an acceleration sensor that detects the tilt angle of the upper turning body 3 by detecting an inclination to a horizontal plane.

An image capturing unit 80 is provided on top of the cover 3*a* of the upper turning body 3. The image capturing unit 80 includes, facing a cabin 10 from the upper turning body 3, a left-side camera 80L that captures an image on the left side, a right-side camera 80R that captures an image on the right side, and a back-side camera 80B that captures an image on the back side. The left-side camera 80L, the right-side camera 80R, and the back-side camera 80B are, for example, digital cameras that contain an imaging device such as a CCD or CMOS, and transmit respective captured images to a display device 40 provided in the cabin 10.

The cabin 10, serving as a cab, is provided on the upper turning body 3. A GPS device (a GNSS receiver) G1 and a transmitter T1 are provided at the top of the cabin 10. The GPS device G1 detects the position of the shovel PS using a GPS function, and feeds position data to a machine guidance device 50 in a controller 30. The transmitter T1 transmits information to the outside of the shovel PS. The transmitter T1 transmits, for example, information that can be received by at least one of a management apparatus FS and a mobile terminal MS described below. The controller 30, the display device 40, an audio output device 43, an input device 45, and a storage device 47 are provided in the cabin 10.

The controller 30 operates as a main control part that controls the driving of the shovel PS. The controller 30 is composed of a processing unit including a CPU and an internal memory. The CPU executes a program stored in the internal memory to implement various functions of the controller 30.

The controller 30 also operates as the machine guidance device 50 that guides operations of the shovel PS. For example, the machine guidance device 50 notifies an operator of work information such as the distance between a target surface that is the surface of a target terrain set by the operator and the working part of the attachment. The distance between the target surface and the working part of the attachment is, for example, the distance between the target surface and the end (teeth tips) of the bucket 6 as an end attachment, the back surface of the bucket 6, the end of a breaker as an end attachment, or the like. The machine guidance device 50 notifies the operator of work information through the display device 40, the audio output device 43, etc., to guide operations of the shovel PS.

While the machine guidance device 50 is incorporated into the controller 30 according to this embodiment, the machine guidance device 50 and the controller 30 may alternatively be provided separately. In this case, like the controller 30, the machine guidance device 50 is composed of a processing unit including a CPU and an internal memory. The CPU executes a program stored in the internal memory to implement various functions of the machine guidance device 50.

The display device 40 displays an image including various kinds of work information in response to a command from the machine guidance device 50 included in the controller 30. The display device 40 is, for example, an in-vehicle liquid crystal display connected to the machine guidance device 50.

The audio output device 43 outputs various kinds of audio information in response to an audio output command from the machine guidance device 50 included in the controller 30. The audio output device 43 includes, for example, an in-vehicle speaker connected to the machine guidance device 50. The audio output device 43 may include an alarm such as a buzzer.

The input device 45 is a device for inputting various kinds of information to the controller 30 including the machine guidance device 50 by the operator of the shovel PS. The input device 45 includes, for example, a membrane switch provided on the surface of the display device 40. The input device 45 may include a touchscreen or the like.

The storage device 47 is a device for storing various kinds of information. The storage device 47 is, for example, a non-volatile storage medium such as a semiconductor memory. The storage device 47 stores various kinds of information output by the controller 30 including the machine guidance device 50, etc.

A gate lock lever 49 is a mechanism provided between the door and the operator's seat of the cabin 10 to prevent the shovel PS from being accidentally operated. When the operator gets onto the operator's seat and pulls up the gate lock lever 49, the operator is prevented from getting out of the cabin 10 and various operating apparatuses become operable. When the operator pushes down the gate lock lever 49, the operator can get out of the cabin 10 and various operating apparatuses become inoperable.

Figure 2:
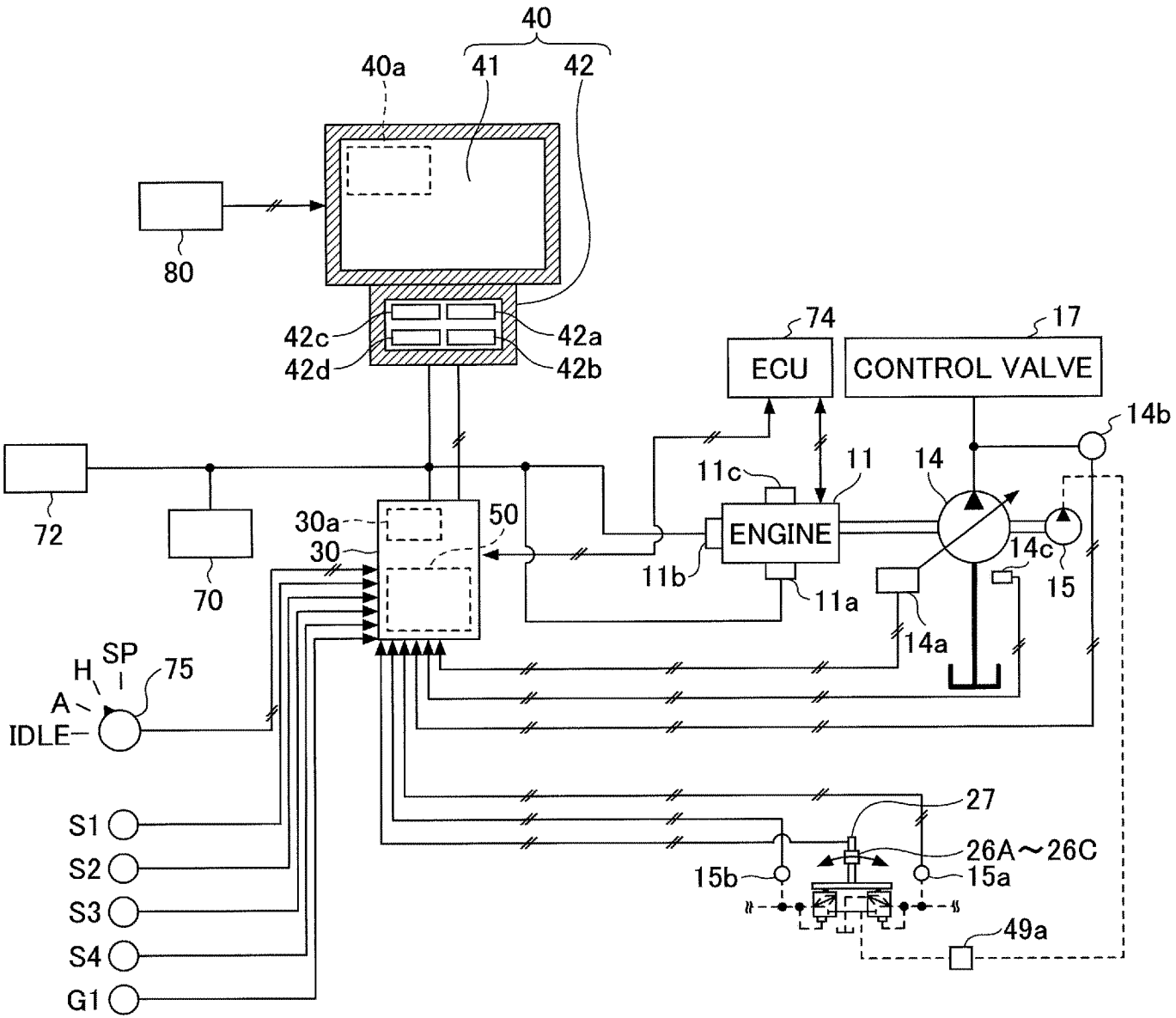
FIG. 2 is a diagram illustrating a configuration of connections including a controller of the shovel according to the embodiment.

FIG. 2 is a diagram illustrating a configuration of connections including the controller 30 of the shovel PS according to the embodiment.

The display device 40 is provided in the cabin 10 to display an image including work information fed from the machine guidance device 50, etc. The display device 40 is connected to the controller 30 including the machine guidance device 50 via a communications network such as a CAN (Controller Area Network) or a LIN (Local Interconnect Network), a dedicated line, or the like.

The display device 40 includes a conversion part 40*a* that generates an image to be displayed on an image display part 41. The conversion part 40*a* generates an image including captured images to be displayed on the image display part 41, based on image data obtained from the image capturing unit 80. Image data are input to the display device 40 from each of the left-side camera 80L, the right-side camera 80R, and the back-side camera 80B.

Furthermore, the conversion part 40*a* converts, into an image signal, data to be displayed on the image display part 41 among various kinds of data input to the display device 40 from the controller 30. The data input to the display device 40 from the controller 30 include, for example, data indicating the temperature of engine coolant water, data indicating the temperature of hydraulic oil, data indicating the remaining amount of an aqueous urea solution, data indicating the remaining amount of fuel, data indicating time information at the time when a parameter of the bucket 6 is set, data indicating time information at the time when a parameter of the bucket 6 is adjusted, etc. In the following, the time information at the time when a parameter of the bucket 6 is set may be referred to as "setting date information" and the time information at the time when a parameter of the bucket 6 is adjusted may be referred to as "adjustment date information."

The conversion part 40*a* outputs image signals after conversion to the image display part 41 to display an image generated based on captured images and various kinds of data on the image display part 41.

The conversion part 40*a* may be provided in not the display device 40 but, for example, the controller 30. In this case, the image capturing unit 80 is connected to the controller 30.

The display device 40 includes a switch panel 42 serving as an input part. The switch panel 42 is a panel including various kinds of hardware switches. The switch panel 42 includes a light switch 42*a*, a windshield wiper switch 42*b*, a windshield washer switch 42*c*, and a display switching switch 42*d*.

The light switch 42*a* is a switch for turning on and off lights attached to the exterior of the cabin 10.

The windshield wiper switch 42*b* is a switch for moving and stopping a windshield wiper.

The windshield washer switch 42*c* is a switch for spraying windshield washer fluid.

The display switching switch 42*d* is a switch for switching an image displayed on the image display part 41. Every time operated, the display switching switch 42*d* switches a screen displayed on the image display part 41. Screens displayed on the image display part 41 include a setting screen, an adjustment screen, and a guidance screen. The setting screen is, for example, a screen that is used to set parameters such as a bucket type and size after replacement of the bucket 6. The adjustment screen is, for example, a screen used to adjust already set parameters of the bucket 6 when a tooth of the bucket 6 is worn by work such as excavation. The guidance screen is a screen used for a worker to use the machine guidance function. These screens may be displayed one (for example, the setting screen or the adjustment screen) over another (for example, the guidance screen) in response to an operation of the display switching switch 42*d*.

The display device 40 is supplied with electric power from a rechargeable battery 70 to operate. The rechargeable battery 70 is charged with electric power generated in an alternator 11*a*(generator) of the engine 11. The electric power of the rechargeable battery 70 is also supplied to electrical equipment 72, etc., of the shovel PS besides the controller 30 and the display device 40. Furthermore, a starter 11*b* of the engine 11 is driven with electric power from the rechargeable battery 70 to start the engine 11.

The engine 11 is connected to a main pump 14 and a pilot pump 15, and is controlled by an engine control unit (ECU) 74. Various data indicating the condition of the engine 11 (for example, data indicating coolant water temperature (a physical quantity) detected with a water temperature sensor 11*c*, etc.) are constantly transmitted from the ECU 74 to the controller 30. The controller 30 can store these data in an internal storage part 30*a* and suitably transmit the data to the display device 40.

The main pump 14 is a hydraulic pump for supplying hydraulic oil to a control valve 17 via a high-pressure hydraulic line. The main pump 14 is, for example, a swash-plate variable displacement hydraulic pump.

The pilot pump 15 is a hydraulic pump for supplying hydraulic oil to various hydraulic control apparatuses via a pilot line. The pilot pump 15 is, for example, a fixed displacement hydraulic pump.

The control valve 17 is a hydraulic controller that controls the hydraulic system of the shovel PS. For example, the control valve 17 selectively supplies hydraulic oil discharged by the main pump 14 to the boom cylinder 7, the arm cylinder 8, the bucket cylinder 9, traveling hydraulic motors, a turning hydraulic motor, etc. In the following, the boom cylinder 7, the arm cylinder 8, the bucket cylinder 9, the traveling hydraulic motors, and the turning hydraulic motor may be referred to as "hydraulic actuators."

Operating levers 26A through 26C are provided in the cabin 10 to be used by the operator to operate hydraulic actuators. When the operating levers 26A through 26C are operated, hydraulic oil is supplied from the pilot pump 15 to the pilot ports of flow control valves corresponding to hydraulic actuators. Each pilot port is supplied with hydraulic oil of a pressure commensurate with the direction of operation and the amount of operation of a corresponding one of the operating levers 26A through 26C.

According to this embodiment, the operating lever 26A is a boom operating lever. The operator can hydraulically drive the boom cylinder 7 to operate the boom 4 when operating the operating lever 26A. The operating lever 26B is an arm operating lever. The operator can hydraulically drive the arm cylinder 8 to operate the arm 5 when operating the operating lever 26B. The operating lever 26C is a bucket operating lever. The operator can hydraulically drive the bucket cylinder 9 to operate the bucket 6 when operating the operating lever 26C. Besides the operating levers 26A through 26C, operating levers, operating pedals, etc., for driving the traveling hydraulic motors, the turning hydraulic motor, etc., may be provided in the shovel PS.

The controller 30 obtains, for example, various kinds of data described below. The data obtained by the controller 30 are stored in the storage part 30*a*.

A regulator 14*a* of the main pump 14, which is a variable displacement hydraulic pump, transmits data indicating a swash plate angle to the controller 30. Furthermore, a discharge pressure sensor 14*b* transmits data indicating the discharge pressure of the main pump 14 to the controller 30. These data (data representing physical quantities) are stored in the storage part 30*a*. Furthermore, an oil temperature sensor 14*c* provided in a conduit between the main pump 14 and a tank storing hydraulic oil that the main pump 14 draws in transmits data representing the temperature of hydraulic oil flowing through the conduit to the controller 30.

Pressure sensors 15*a* and 15*b* detect a pilot pressure transmitted to the control valve 17 when the operating levers 26A through 26C are operated, and transmit data indicating the detected pilot pressure to the controller 30. The operating levers 26A through 26C are provided with a switch button 27. The operator can transmit a command signal to the controller 30 by operating the switch button 27 while operating the operating levers 26A through 26C.

An engine rotational speed adjustment dial 75 is provided in the cabin 10. The engine rotational speed adjustment dial 75 is a dial for adjusting the engine rotational speed, and, for example, can switch the engine rotational speed in a stepwise manner. According to this embodiment, the engine rotational speed adjustment dial 75 is provided to enable the engine rotational speed to be switched among the four levels of SP mode, H mode, A mode, and idling mode. The engine rotational speed adjustment dial 75 transmits data indicating the setting of the engine rotational speed to the controller 30. FIG. 2 illustrates a state where the H mode is selected by the engine rotational speed adjustment dial 75.

The SP mode is a rotational speed mode selected when it is desired to prioritize workload, and uses the highest engine rotational speed. The H mode is a rotational speed mode selected when it is desired to satisfy both workload and fuel efficiency, and uses the second highest engine rotational speed. The A mode is a rotational speed mode selected when it is desired to operate the shovel PS with low noise while prioritizing fuel efficiency, and uses the third highest engine rotational speed. The idling mode is a rotational speed mode selected when it is desired to idle the engine 11, and uses the lowest engine rotational speed. The engine 11 is controlled to a constant rotational speed at the engine rotational speed of the rotational speed mode set by the engine rotational speed adjustment dial 75.

Next, various functions provided in the controller 30 and the machine guidance device 50 of the shovel PS are described.

Figure 3:
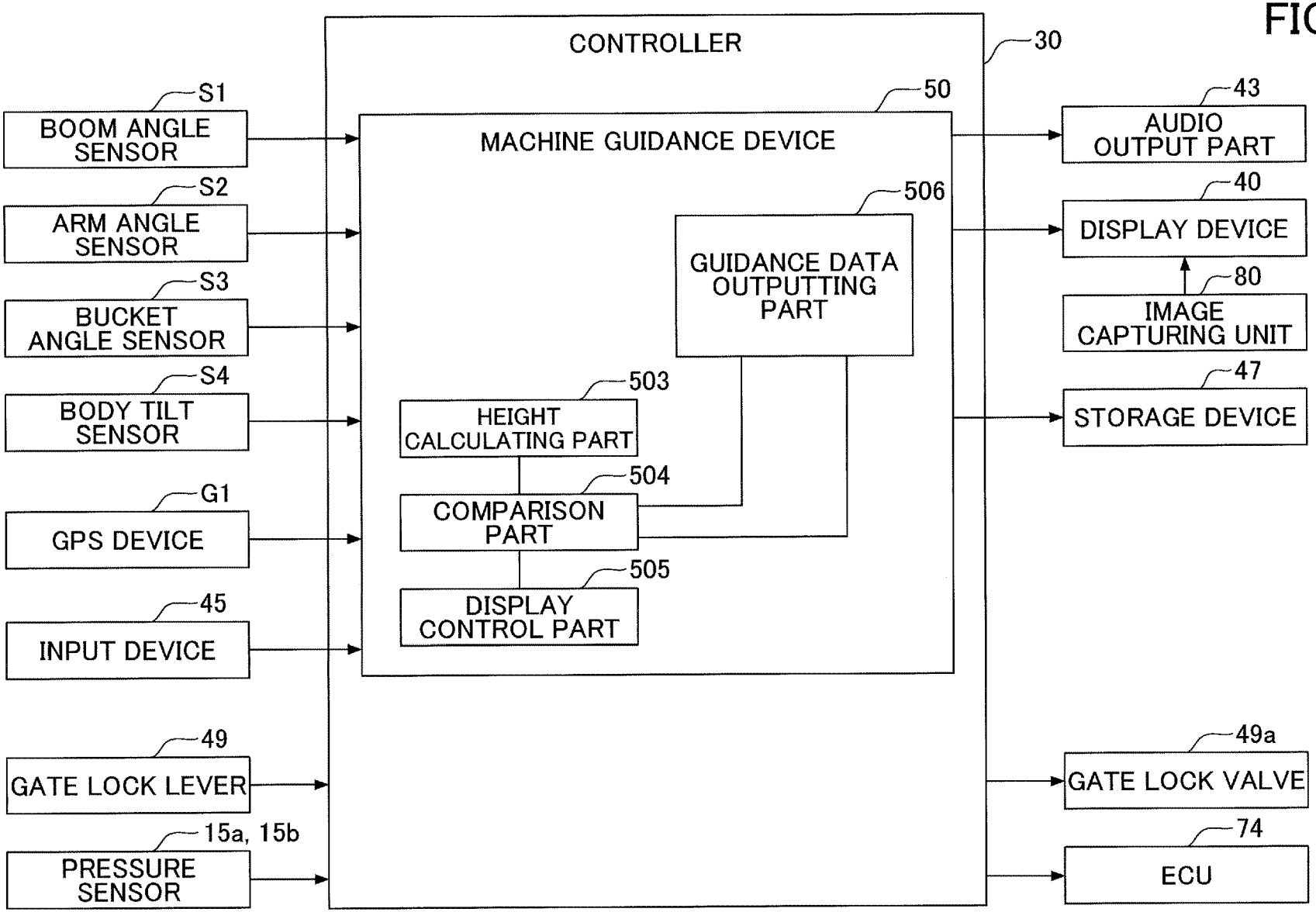
FIG. 3 is a diagram illustrating a configuration of the controller and a machine guidance device according to the embodiment.

FIG. 3 is a diagram illustrating a configuration of the controller 30 and the machine guidance device 50 according to the embodiment.

The controller 30 controls the entire shovel PS including the ECU 74. The controller 30 performs control to close a gate lock valve 49*a* when the gate lock lever 49 is pushed down and to open the gate lock valve 49*a* when the gate lock lever 49 is pulled up. The gate lock valve 49*a* is a selector valve provided in an oil passage between the control valve 17 and the operating levers 26A through 26C, etc. Here, the gate lock valve 49*a* is configured to be opened or closed based on a command from the controller 30. Alternatively, the gate lock valve 49*a* may be mechanically connected to the gate lock lever 49 to be opened or closed in response to the operation of the gate lock lever 49.

The gate lock valve 49*a* is closed to interrupt a flow of hydraulic oil between the control valve 17 and the operating levers 26A through 26C, etc., to disable the operating levers 26A through 26C, etc. The gate lock valve 49*a* is opened to allow passage of hydraulic oil between the control valve 17 and the operating levers, etc., to enable the operating levers 26A through 26C, etc.

The controller 30 detects the amount of operation of each lever from a pilot pressure detected by the pressure sensor 15*a* or 15*b* with the gate lock valve 49*a* being opened to have the operating levers 26A through 26*c* enabled.

In addition to controlling the operation of the entire shovel PS, the controller 30 controls whether to give guidance by the machine guidance device 50. Specifically, in response to determining that the shovel is not working, the controller 30 transmits a guidance stop command to the machine guidance device 50 to stop guidance by the machine guidance device 50.

The controller 30 may output a guidance stop command to the machine guidance device 50 when outputting an automatic idling stop command to the ECU 74. Alternatively, the controller 30 may output a guidance stop command to the machine guidance device 50 in response to determining that the gate lock lever 49 is pushed down.

Next, the machine guidance device 50 is described. The machine guidance device 50 receives various signals and data supplied to the controller 30, from the boom angle sensor S1, the arm angle sensor S2, the bucket angle sensor S3, the body tilt sensor S4, the GPS device G1, the input device 45, etc.

The machine guidance device 50 calculates the actual operating position of the attachment such as the bucket 6 based on the received signals and data. Then, the machine guidance device 50 compares the actual operating position of the attachment and a target surface, and calculates, for example, the distance between the bucket 6 and the target surface. The machine guidance device 50 also calculates the distance from the turning central axis of the shovel PS to the teeth tips of the bucket 6, the inclination angle of the target surface, etc., and transmits these to the display device 40 as work information.

When the machine guidance device 50 and the controller 30 are provided separately, the machine guidance device 50 and the controller 30 are connected through a CAN to be able to communicate with each other.

The machine guidance device 50 includes a height calculating part 503, a comparison part 504, a display control part 505, and a guidance data outputting part 506.

The height calculating part 503 calculates the height of the end (teeth tips) of the bucket 6 from the angles of the boom 4, the arm 5, and the bucket 6 determined from the detection signals of the boom angle sensor S1, the arm angle sensor S2, and the bucket angle sensor S3.

The comparison part 504 compares the height of the end (teeth tips) of the bucket 6 calculated by the height calculating part 503 and the position of the target surface shown in the guidance data output by the guidance data outputting part 506. Furthermore, the comparison part 504 determines the inclination angle of the target surface relative to the shovel PS. Various kinds of data determined in the height calculating part 503 and the comparison part 504 are stored in the storage device 47.

The display control part 505 transmits the height of the bucket 6 and the inclination angle of the target surface, as determined by the comparison part 504, to the display device 40 as work information. The display device 40 displays the work information transmitted from the display control part 505, together with a captured image transmitted from the image capturing unit 80, on the screen. A display screen layout of the display device 40 is described below. Furthermore, in such cases where the bucket 6 is positioned lower than the target surface, the display control part 505 can issue an alarm to the operator through the audio output device 43.

Next, display screen layouts of the display device 40 are described in order of the setting screen, the adjustment screen, and the guidance screen.

Figure 4:
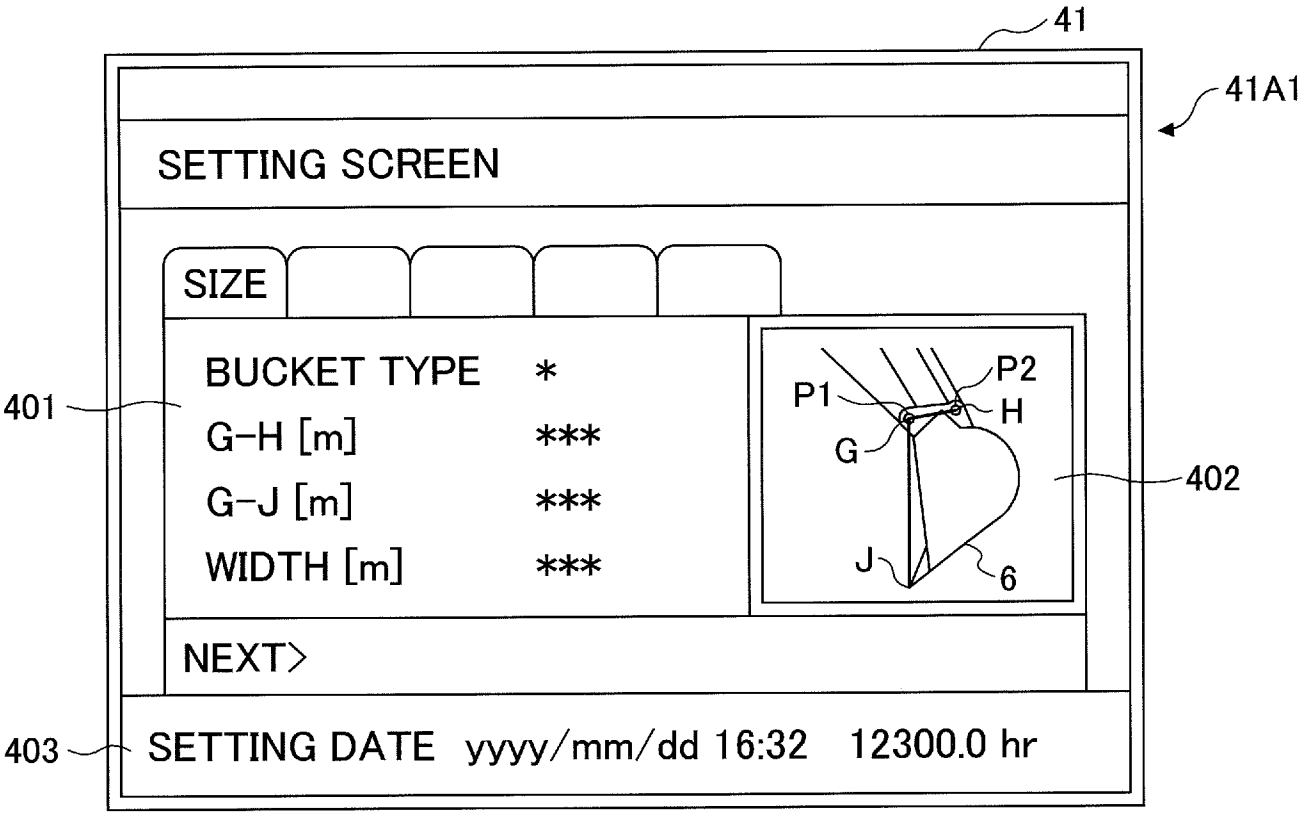
FIG. 4 is a diagram illustrating an example of a setting screen displayed on an image display part of a display device according to the embodiment.

FIG. 4 is a diagram illustrating an example of the setting screen displayed on the image display part 41 of the display device 40 according to the embodiment.

As illustrated in FIG. 4, a setting screen 41A1 includes a parameter display part 401, a bucket display part 402, and a setting date display part 403. An image displayed in each part is generated from various kinds of data transmitted from the controller 30 by the conversion part 40*a* of the display device 40.

The parameter display part 401 displays the values of the parameters of the bucket 6 that are setting targets. The bucket 6 attached to the shovel PS varies in kind (type). The parameter display part 401 displays, for example, a number, a G-H length, a G-J length, and a bucket width corresponding to a bucket type. The G-H length is the length of a line segment connecting an arm top pin position G, which is the center position of the arm top pin P1, and a bucket link pin position H, which is the center position of the bucket link pin P2. The G-J length is the length of a line segment connecting the arm top pin position G and a bucket end position J, which is the position of the end (teeth tips) of the bucket 6. Specifically, when the operator selects the bucket 6, the parameter display part 401 displays the pre-registered G-H length, G-J length, and bucket width. This makes it possible for the operator to recognize the values of various kinds of parameters by the displayed contents of the parameter display part 401. Furthermore, after selecting the bucket 6, the operator can edit the G-H length, G-J length, and bucket width displayed in the parameter display part 401 as desired. In the illustration of FIG. 4, "*" is displayed as a number corresponding to the bucket type, "*" is displayed as a G-H length corresponding to the bucket type, "*" is displayed as a G-J length corresponding to the bucket type, and "*" is displayed as a bucket width corresponding to the bucket type, and the operator can recognize the values of various kinds of parameters. Thus, by using the detection values of the posture sensors and parameters of the bucket 6, the position of the blade edge of the bucket 6** relative to reference coordinates such as the coordinates of a point on the turning axis of the shovel PS or the coordinates of a point on a boom foot pin can be calculated.

The bucket display part 402 displays lengths corresponding to parameters displayed in the parameter display part 401, together with an image representing the bucket 6. In the illustration of FIG. 4, the G-H length and the G-J length are displayed together with an image representing the bucket 6, so that the operator can easily recognize which parts' lengths the G-H length and the G-J length are in the bucket 6.

The setting date display part 403 displays the latest setting date information. The setting date information is information on the time when the parameters of the bucket 6 are set, and includes, for example, the date and time and cumulative time information including the cumulative operating time of the engine 11, the cumulative usage time of the bucket 6, and the cumulative operating time of the attachment at the time when the parameters of the bucket 6 are set.

The cumulative usage time of the bucket 6 is the time during which it is determined that the bucket 6 is in operation. The controller 30 determines whether the bucket 6 is in operation based on a change in the output signals of the boom angle sensor S1, the arm angle sensor S2, and the bucket angle sensor S3. The controller 30 may determine whether the bucket 6 is in operation by other methods.

The cumulative operating time of the attachment is the time during which it is determined that the attachment is in operation. The controller 30 determines whether the attachment is in operation based on the detection results of the pressure sensors 15*a* and 15*b*. For example, the controller 30 determines that the attachment is in operation when any of the operating levers 26A through 26C is operated and a pilot pressure detected by the pressure sensor 15*a* or 15*b* becomes a predetermined value or more. Furthermore, the controller 30 determines that the attachment is not in operation when a pilot pressure detected by the pressure sensor 15*a* or 15*b* is less than the predetermined value. The controller 30 may determine whether the attachment is in operation by other methods.

In the illustration of FIG. 4, "yyyy/mm/dd 16:32" is displayed as a date and time, and "12300.0 hr" is displayed as the cumulative operating time of the engine 11, so that the operator can recognize the date and time when the parameters of the bucket 6 were last set and the cumulative operating time of the engine 11.

Thus, on the setting screen 41A1, the setting date information is displayed in the setting date display part 403. This makes it possible for the operator to recognize the date and time when the parameters of the bucket 6 were last set, etc., by checking the displayed contents of the setting screen 41A1. Therefore, the operator can replace the bucket 6 at an appropriate time by comparing the date and time of the last setting of the parameters of the bucket 6, etc., and a current date and time, etc. Instead of replacing the bucket 6, the operator may replace only a tooth/teeth of the bucket 6.

The area layout of the setting screen 41A1 is an example, and is not limited to the configuration illustrated in this embodiment.

Figure 5:
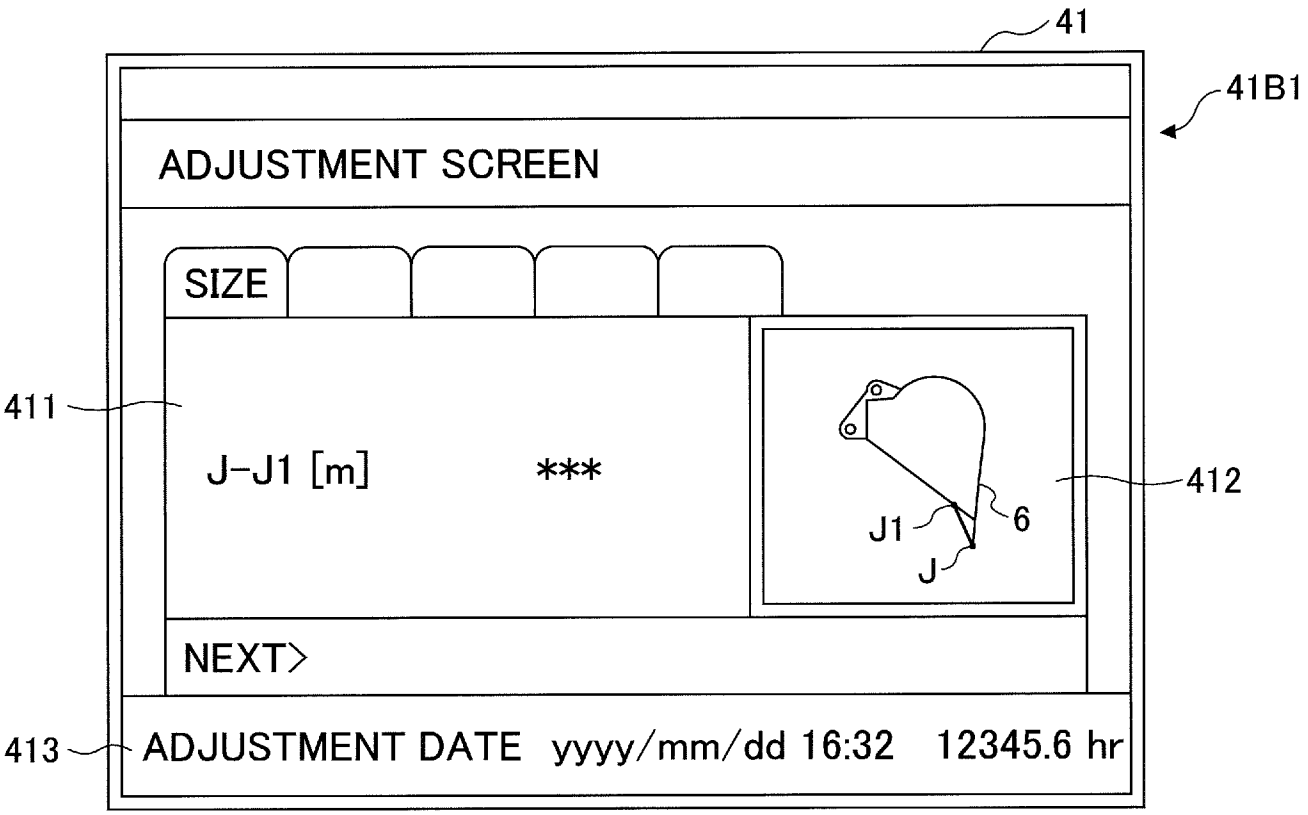
FIG. 5 is a diagram illustrating an example of an adjustment screen displayed on the image display part of the display device according to the embodiment.

FIG. 5 is a diagram illustrating an example of the adjustment screen displayed on the image display part 41 of the display device 40 according to the embodiment. As illustrated in FIG. 5, an adjustment screen 41B1 includes a parameter display part 411, a bucket display part 412, and an adjustment date display part 413. An image displayed in each part is generated from various kinds of data transmitted from the controller 30 by the conversion part 40*a* of the display device 40.

The parameter display part 411 displays the value of a parameter of the bucket 6 that is an adjustment target. The teeth tips of the bucket 6 are worn by performing work such as excavation with the bucket 6. The parameter display part 411 displays, for example, a J-J1 length that is the length of the teeth of the bucket 6. The J-J1 length is the length of a line segment connecting the bucket end position J and a teeth attachment position J1 that is the attachment position of the teeth. In the illustration of FIG. 5, "*" is displayed as the J-J1 length, and the operator can recognize that the J-J1 length is "*."

The bucket display part 412 displays a length corresponding to a parameter displayed in the parameter display part 411, together with an image representing the bucket 6. In the illustration of FIG. 5, the J-J1 length is displayed together with an image representing the bucket 6, so that the operator can easily recognize which part's length the J-J1 length is in the bucket 6.

The adjustment date display part 413 displays the latest adjustment date information. The adjustment date information is time information at the time when a parameter of the bucket 6 is adjusted, and includes, for example, a date and time, the cumulative operating time of the engine 11, the cumulative usage time of the bucket 6, and the cumulative operating time of the attachment.

The cumulative usage time of the bucket 6 is displayed based on the time during which it is determined that the bucket 6 is in operation. The controller 30 determines whether the bucket 6 is in operation based on a change in the output signals of the boom angle sensor S1, the arm angle sensor S2, and the bucket angle sensor S3. The controller 30 may determine whether the bucket 6 is in operation by other methods.

The cumulative operating time of the attachment is the time during which it is determined that the attachment is in operation. The controller 30 determines whether the attachment is in operation based on the detection results of the pressure sensors 15*a* and 15*b*. For example, the controller 30 determines that the attachment is in operation when any of the operating levers 26A through 26C is operated and a pilot pressure detected by the pressure sensor 15*a* or 15*b* becomes a predetermined value or more. Furthermore, the controller 30 determines that the attachment is not in operation when a pilot pressure detected by the pressure sensor 15*a* or 15*b* is less than the predetermined value. The controller 30 may determine whether the attachment is in operation by other methods.

In the illustration of FIG. 5, "yyyy/mm/dd 16:32" is displayed as a date and time, and "12345.6 hr" is displayed as the cumulative operating time of the engine 11, so that the operator can recognize the date and time and the cumulative operating time of the engine 11 at the time when a parameter of the bucket 6 was last adjusted.

Thus, on the adjustment screen 41B1, the adjustment date information is displayed in the adjustment date display part 413. This makes it possible for the operator to recognize the date and time when a parameter of the bucket 6 was last adjusted, etc., by checking the adjustment screen 41B1. Therefore, the operator can adjust a parameter of the bucket 6 at an appropriate time by comparing the date and time of the last adjustment of a parameter of the bucket 6, etc., and a current date and time, etc.

The area layout of the adjustment screen 41B1 is an example, and is not limited to the configuration illustrated in this embodiment.

For example, in addition to those described above, the adjustment screen 41B1 may include an alarm display part to display information indicating the necessity of adjustment of a parameter of the bucket 6. The alarm display part displays information indicating the necessity of adjustment of a parameter of the bucket 6 when a predetermined time has passed since the adjustment of a parameter of the bucket 6. This makes it possible to prevent the operator from performing work such as excavation without adjusting a parameter of the bucket 6 when it is necessary to adjust the parameter of the bucket 6.

Figure 6:
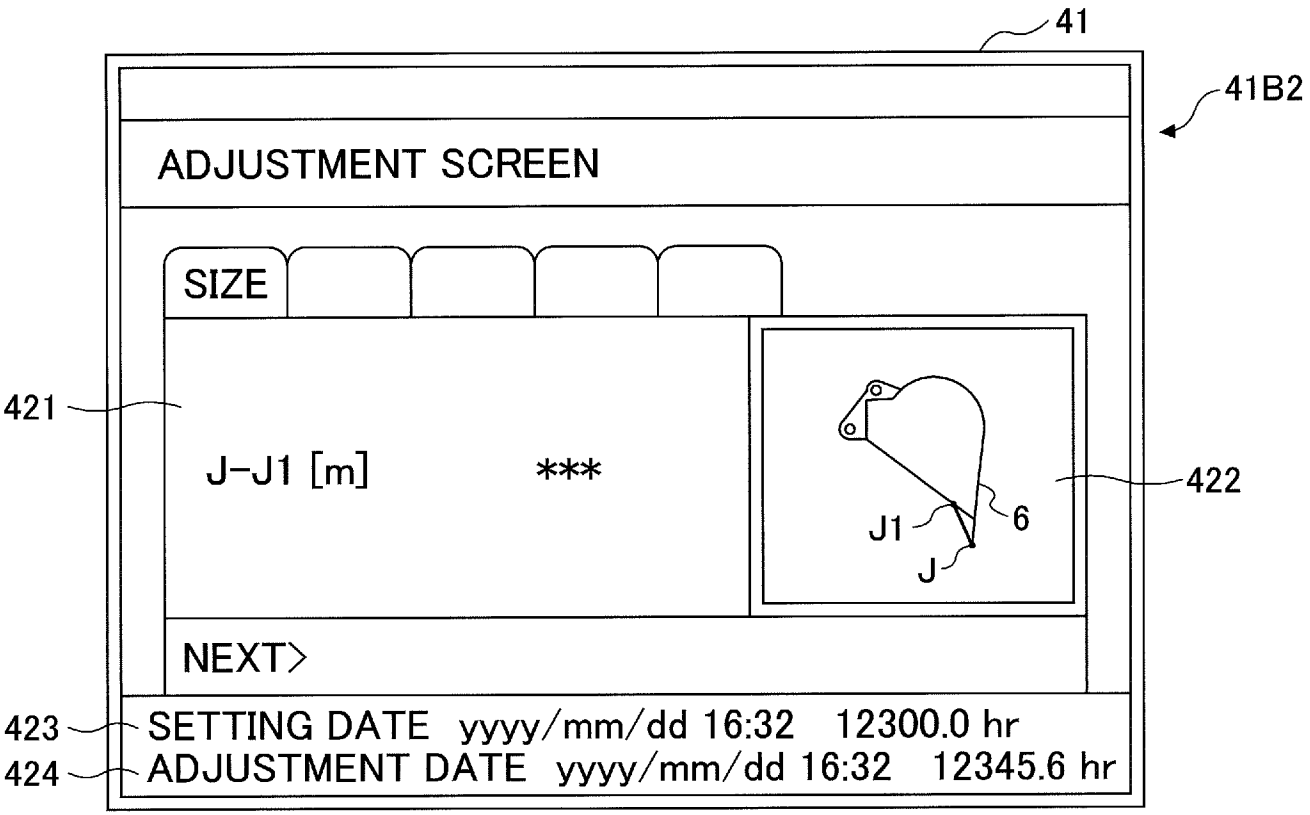
FIG. 6 is a diagram illustrating another example of the adjustment screen displayed on the image display part of the display device according to the embodiment.

FIG. 6 is a diagram illustrating another example of the adjustment screen displayed on the image display part 41 of the display device 40 according to the embodiment. As illustrated in FIG. 6, an adjustment screen 41B2 includes a parameter display part 421, a bucket display part 422, a setting date display part 423, and an adjustment date display part 424. An image displayed in each part is generated from various kinds of data transmitted from the controller 30 by the conversion part 40*a* of the display device 40.

The same as in the adjustment screen 41B1, the parameter display part 421 displays the value of a parameter of the bucket 6 that is an adjustment target. In the illustration of FIG. 6, "*" is displayed as the J-J1 length, and the operator can recognize that the J-J1 length is "*."

The same as in the adjustment screen 41B1, the bucket display part 422 displays a length corresponding to a parameter displayed in the parameter display part 421, together with an image representing the bucket 6.

The same as in the setting screen 41A1, the setting date display part 423 displays the setting date information. In the illustration of FIG. 6, "yyyy/mm/dd 16:32" is displayed as a date and time, and "12300.0 hr" is displayed as the cumulative operating time of the engine 11. This makes it possible for the operator to recognize the date and time when the parameters of the bucket 6 were last set and the cumulative operating time of the engine 11.

The same as in the adjustment screen 41B1, the adjustment date display part 424 displays the adjustment date information. In the illustration of FIG. 6, "yyyy/mm/dd 16:32" is displayed as a date and time, and "12345.6 hr" is displayed as the cumulative operating time of the engine 11. This makes it possible for the operator to recognize the date and time when a parameter of the bucket 6 was last adjusted and the cumulative operating time of the engine 11.

Thus, on the adjustment screen 41B2, the setting date information is displayed in the setting date display part 423, and the adjustment date information is displayed in the adjustment date display part 424. This makes it possible for the operator to recognize the date and time of the last setting of the parameters of the bucket 6, etc., and the date and time when a parameter of the bucket 6 was last adjusted, etc., by checking the adjustment screen 41B2. Therefore, the operator can replace the bucket 6 and adjust a parameter of the bucket 6 at an appropriate time by comparing these dates and times, etc., and a current date and time, etc.

The area layout of the adjustment screen 41B2 is an example, and is not limited to the configuration illustrated in this embodiment.

For example, in addition to those described above, the adjustment screen 41B2 may include an alarm display part to display information indicating the necessity of adjustment of a parameter of the bucket 6. The alarm display part displays information indicating the necessity of adjustment of a parameter of the bucket 6 when a predetermined time has passed since the adjustment of a parameter of the bucket 6. This makes it possible to prevent the operator from performing work such as excavation without adjusting a parameter of the bucket 6 when it is necessary to adjust the parameter of the bucket 6.

Figure 7:
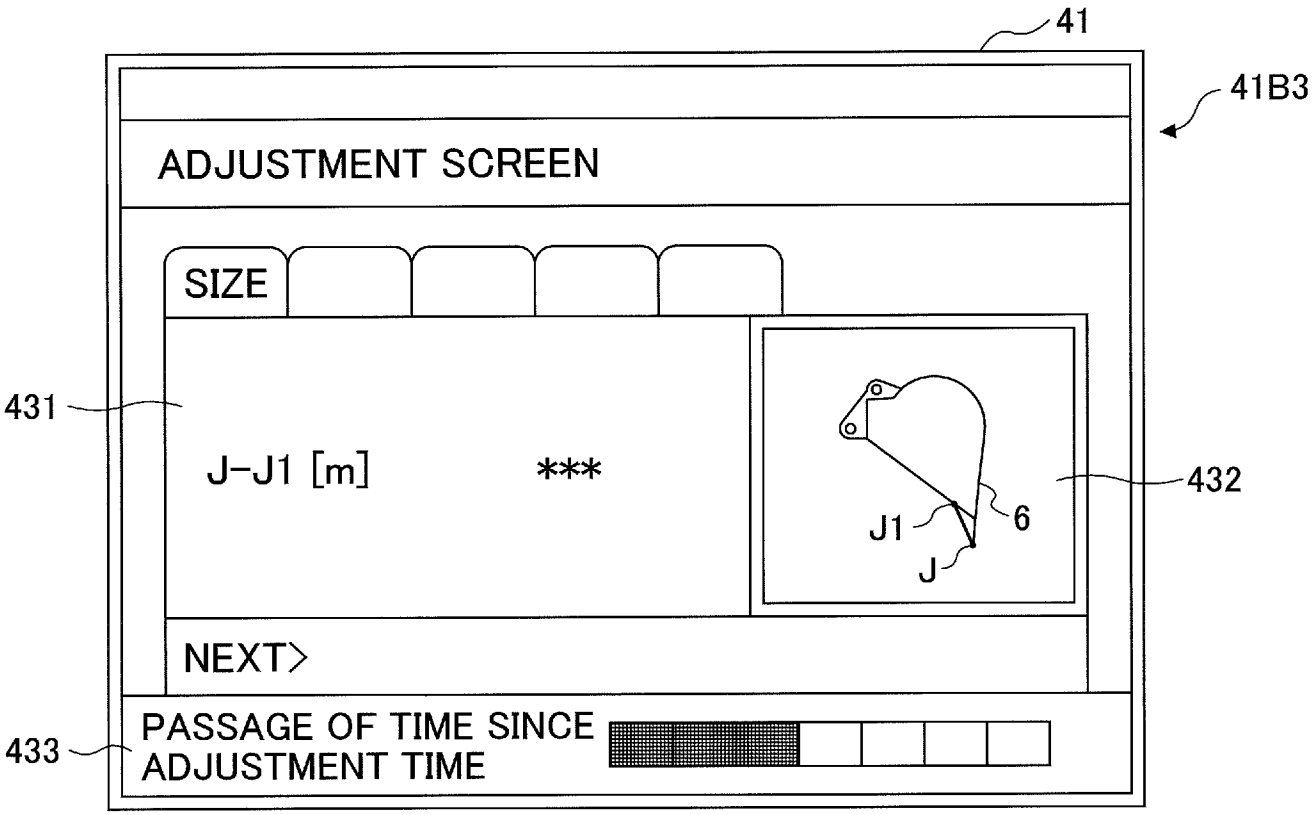
FIG. 7 is a diagram illustrating yet another example of the adjustment screen displayed on the image display part of the display device according to the embodiment.

FIG. 7 is a diagram illustrating yet another example of the adjustment screen displayed on the image display part 41 of the display device 40 according to the embodiment. As illustrated in FIG. 7, an adjustment screen 41B3 includes a parameter display part 431, a bucket display part 432, and an adjustment date display part 433. An image displayed in each part is generated from various kinds of data transmitted from the controller 30 by the conversion part 40*a* of the display device 40.

The same as in the adjustment screen 41B1, the parameter display part 431 displays the value of a parameter of the bucket 6 that is an adjustment target. In the illustration of FIG. 7, "*" is displayed as the J-J1 length, and the operator can recognize that the J-J1 length is "*."

The same as in the adjustment screen 41B1, the bucket display part 432 displays a length corresponding to a parameter displayed in the parameter display part 431, together with an image representing the bucket 6.

The adjustment date display part 433 displays the adjustment date information. The adjustment date information is, for example, a bar graph indicating a condition including the operating time of the engine 11, the usage time of the bucket 6, and the operating time of the attachment with reference to the time when a parameter of the bucket 6 was last adjusted (0 hr).

In the illustration of FIG. 7, the operating time of the engine 11 with reference to the time of the last adjustment of a parameter of the bucket 6 is displayed using multiple laterally arranged bars. According to this embodiment, of the seven bars, the left three are displayed in a color different than the right four, indicating that the engine 11 has operated for three-sevenths of a preset predetermined engine operating time. The predetermined engine operating time is so determined as to be an engine operating time corresponding to the time to adjust a parameter of the bucket 6. To make it possible to more accurately display the time to adjust a parameter of the bucket 6, the adjustment date information may be composed of a larger number of bars. Furthermore, a single bar (graduation) may be determined as a predetermined (for example, 12 hours). When the next adjustment time is preset, the proportion of time up to the next adjustment time may be displayed.

Thus, on the adjustment screen 41B3, current time information relative to the time to adjust a parameter of the bucket 6 is displayed in a bar graph in the adjustment date display part 433. This makes it possible for the operator to easily recognize whether it is necessary to adjust a parameter of the bucket 6 by checking the adjustment screen 41B3. Therefore, the operator can adjust a parameter of the bucket 6 at an appropriate time.

The area layout of the adjustment screen 41B3 is an example, and is not limited to the configuration illustrated in this embodiment.

For example, in addition to those described above, the adjustment screen 41B3 may include an alarm display part to display information indicating the necessity of adjustment of a parameter of the bucket 6. The alarm display part displays information indicating the necessity of adjustment of a parameter of the bucket 6 when a predetermined time has passed since the adjustment of a parameter of the bucket 6. This makes it possible to prevent the operator from performing work such as excavation without adjusting a parameter of the bucket 6 when it is necessary to adjust the parameter of the bucket 6.

Figure 8:
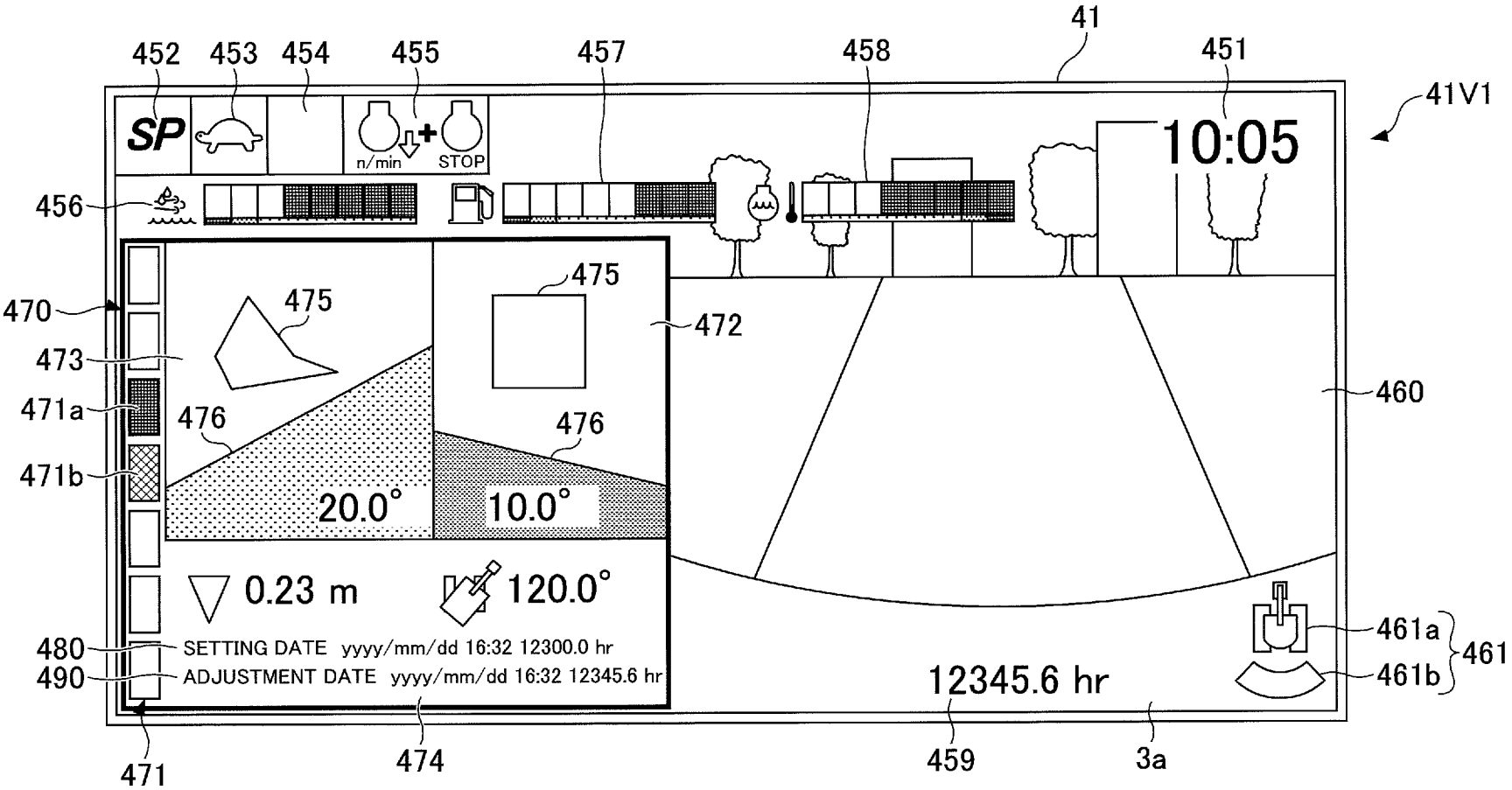
FIG. 8 is a diagram illustrating an example of a guidance screen displayed on the image display part of the display device according to the embodiment.

FIG. 8 is a diagram illustrating an example of the guidance screen displayed on the image display part 41 of the display device 40 according to the embodiment. A guidance screen 41V1 illustrated in FIG. 8 is displayed when the shovel PS is in operation, such as when the gate lock lever 49 is released or when any of the operating levers 26A through 26C is operated. As illustrated in FIG. 8, the guidance screen 41V1 includes a time display part 451, a rotational speed mode display part 452, a traveling mode display part 453, an attachment display part 454, an engine control status display part 455, a remaining aqueous urea solution amount display part 456, a remaining fuel amount display part 457, a coolant water temperature display part 458, an engine operating time display part 459, a captured image display part 460, a work guidance display part 470, a setting date display part 480, and an adjustment date display part 490. Images displayed in the parts are generated from various kinds of data transmitted from the controller 30 and captured images transmitted from the image capturing unit 80 by the conversion part 40*a* of the display device 40.

The time display part 451 displays a current time. In the illustration of FIG. 8, a digital display is employed, and a current time (10:05) is shown.

The rotational speed mode display part 452 displays a rotational speed mode set by the engine rotational speed adjustment dial 75 in an image. The rotational speed mode includes, for example, the above-described four modes, namely, SP mode, H mode, A mode, and idling mode. In the illustration of FIG. 8, a symbol "SP" representing SP mode is displayed.

The traveling mode display part 453 displays a traveling mode. The traveling mode represents the setting of traveling hydraulic motors using a variable displacement pump. For example, the traveling mode includes a low-speed mode and a high-speed mode. A "turtle"-shaped mark is displayed in the low-speed mode, and a "rabbit"-shaped mark is displayed in the high-speed mode. In the illustration of FIG. 8, the "turtle"-shaped mark is displayed to make it possible for the operator to recognize that the low-speed mode is set.

The attachment display part 454 displays an image representing an attachment that is attached. Various attachments such as the bucket 6, a rock drill, a grapple, and a lifting magnet are attached to the shovel PS. The attachment display part 454 displays, for example, marks shaped like these end attachments and numbers corresponding to the attachments. According to this embodiment, the bucket 6 is attached as an end attachment, and as illustrated in FIG. 8, the attachment display part 454 is blank. When a rock drill is attached as an end attachment, for example, a rock drill-shaped mark is displayed together with a number representing the magnitude of the output of the rock drill in the attachment display part 454.

The engine control status display part 455 displays the control status of the engine 11. In the illustration of FIG. 8, "automatic deceleration and automatic stop mode" is selected as the control status of the engine 11. The "automatic deceleration and automatic stop mode" means a control status to automatically reduce the engine rotational speed and further to automatically stop the engine 11 in accordance with the duration of a low engine load condition. Other control statuses of the engine 11 include "automatic deceleration mode," "automatic stop mode," and "manual deceleration mode."

The remaining aqueous urea solution amount display part 456 displays the status of the remaining amount of an aqueous urea solution stored in an aqueous urea solution tank in an image. In the illustration of FIG. 8, a bar graph representing a current status of the remaining amount of an aqueous urea solution is displayed. The remaining amount of an aqueous urea solution is displayed based on the output data of a remaining aqueous urea solution amount sensor provided in the aqueous urea solution tank.

The remaining fuel amount display part 457 displays the status of the remaining amount of fuel stored in a fuel tank. In the illustration of FIG. 8, a bar graph representing a current status of the remaining amount of fuel is displayed. The remaining amount of fuel is displayed based on the output data of a remaining fuel amount sensor provided in the fuel tank.

The coolant water temperature display part 458 displays the temperature condition of engine coolant water. In the illustration of FIG. 8, a bar graph representing the temperature condition of engine coolant water is displayed. The temperature of engine coolant water is displayed based on the output data of the water temperature sensor 11*c* provided on the engine 11.

The engine operating time display part 459 displays the cumulative operating time of the engine 11. In the illustration of FIG. 8, a cumulative operating time since the restart of counting by the operator is displayed together with a unit "hr (hour)." A lifelong operating time in the entire period after the manufacture of the shovel PS or a section operating time since the restart of counting by the operator is displayed in the engine operating time display part 459.

The captured image display part 460 displays an image captured by the image capturing unit 80. In the illustration of FIG. 8, an image captured by the back-side camera 80B is displayed in the captured image display part 460. A captured image captured by the left-side camera 80L or the right-side camera 80R may also be displayed in the captured image display part 460. Furthermore, images captured by two or more of the left-side camera 80L, the right-side camera 80R, and the back-side camera 80B may also be displayed side by side in the captured image display part 460. Moreover, an overhead view image into which captured images captured by the left-side camera 80L, the right-side camera 80R, and the back-side camera 80B, respectively, are combined may also be displayed in the captured image display part 460.

Each camera is so installed as to include part of the cover 3*a* of the upper turning body 3 in a captured image. With part of the cover 3*a* included in a displayed image, the operator has a better sense of distance between an object displayed in the captured image display part 460 and the shovel PS.

In the captured image display part 460, an image capturing unit icon 461 representing the orientation of the image capturing unit 80 that has captured a captured image that is being displayed is displayed. The image capturing unit icon 461 is composed of a shovel icon 461*a* representing the shape of the shovel PS in a top plan view and a strip-shaped orientation indicator icon 461*b* representing the orientation of the image capturing unit 80 that has captured a captured image that is being displayed.

In the illustration of FIG. 8, the orientation indicator icon 461*b* is displayed below the shovel icon 461*a* (on the opposite side from the attachment) to indicate that a rear-view image of the shovel captured with the back-side camera 80B is displayed in the captured image display part 460. For example, when an image captured with the right-side camera 80R is displayed in the captured image display part 460, the orientation indicator icon 461*b* is displayed to the right of the shovel icon 461*a*. For example, when an image captured with the left-side camera 80L is displayed in the captured image display part 460, the orientation indicator icon 461*b* is displayed to the left of the shovel icon 461*a*.

For example, the operator can switch an image to display in the captured image display part 460 to an image captured by another camera or the like by depressing an image change switch provided in the cabin 10.

When the shovel PS is not provided with the image capturing unit 80, different information may be displayed in place of the captured image display part 460.

The work guidance display part 470 includes a position indicator image 471, a first target surface display image 472, a second target surface display image 473, and a numerical value information image 474, and displays various kinds of work information.

The position indicator image 471 is a bar graph of vertically arranged bars, and shows a distance from the working part of the attachment (for example, the end of the bucket 6) to a target surface. According to this embodiment, in accordance with the distance from the end of the bucket 6 to the target surface, one of the seven bars serves as a bucket position indicator bar 471*a* (the third bar from the top in FIG. 8) that is displayed in a color different from that of the other bars. The bucket position indicator bar 471*a* indicates the current position of the working part of the attachment (for example, the end of the bucket 6). Furthermore, a central bar 471*b* among the seven bars (the fourth bar from the top in FIG. 8) indicates the target surface. For example, when the bucket position indicator bar 471*a* coincides with the central bar 471*b*, it is indicated that the end of the bucket 6 is currently positioned at the target surface. The position indicator image 471 may be composed of a larger number of bars to make it possible to more accurately display the distance from the end of the bucket 6 to the target surface.

For example, as the distance from the end of the bucket 6 to the target surface becomes greater, an upper bar is displayed in a color different from that of the other bars as the bucket position indicator bar 471*a*. Furthermore, as the distance from the end of the bucket 6 to the target surface becomes smaller, a lower bar is displayed in a color different from that of the other bars as the bucket position indicator bar 471*a*. Thus, the bucket position indicator bar 471*a* is so displayed as to move upward or downward in accordance with the distance from the end of the bucket 6 to the target surface. The operator can understand the distance from the end of the bucket 6 to the target surface by looking at the position indicator image 471.

The first target surface display image 472 schematically shows the relationship between the bucket 6 and the target surface. In the first target surface display image 472, the bucket 6 and the target surface in a forward looking view from the shovel PS that the operator seated in the cabin 10 has are schematically displayed with a bucket icon 475 and a target surface 476. The bucket icon 475 is shown in the shape of the bucket 6 viewed from the cabin 10. The target surface 476 is displayed with the tilt angle of the bucket 6 relative to the actual target surface (10.0° in the illustration of FIG. 8). The interval between the bucket icon 475 and the target surface 476 is so displayed as to vary in accordance with the actual distance from the end of the bucket 6 to the target surface. Likewise, the tilt angle of the bucket 6 is so displayed as to vary in accordance with the actual positional relationship between the bucket 6 and the target surface.

The operator can understand the positional relationship between the bucket 6 and the target surface and the inclination angle of the target surface by viewing the first target surface display image 472. In the first target surface display image 472, the target surface 476 may be displayed with an inclination angle that is greater than actually is to improve visibility for the operator. The operator can recognize an approximate inclination angle from the target surface 476 displayed in the first target surface display image 472. Furthermore, when the operator desires to know a precise inclination angle, the operator can know an actual inclination angle by viewing an inclination angle numerically displayed below the target surface 476.

The second target surface display image 473 schematically shows the relationship between the bucket 6 and the target surface viewed from the side. In the second target surface display image 473, the bucket icon 475 and the target surface 476 are displayed. The bucket icon 475 is shown in the shape of the bucket 6 viewed from the side. The target surface 476 is displayed with an inclination angle relative to a horizontal plane (20.0° in the illustration of FIG. 8). The interval between the bucket icon 475 and the target surface 476 is so displayed as to vary in accordance with the actual distance from the end of the bucket 6 to the target surface. The inclination angle is so displayed as to vary in accordance with the actual positional relationship between the bucket 6 and the target surface.

The operator can understand the positional relationship between the bucket 6 and the target surface and the inclination angle of the target surface by looking at the second target surface display image 473. In the second target surface display image 473, the target surface 476 may be displayed with an inclination angle that is greater than actually is to improve visibility for the operator. The operator can recognize an approximate inclination angle from the target surface 476 displayed in the second target surface display image 473. Furthermore, when the operator desires to know a precise inclination angle, the operator can know an actual inclination angle by looking at an inclination angle numerically displayed below the target surface 476.

The numerical value information image 474 displays various kinds of numerical values indicating the positional relationship between the end of the bucket 6 and the target surface, etc. In the numerical value information image 474, the turning angle of the upper turning body 3 relative to a reference (120.0° in the illustration of FIG. 8) is displayed together with an icon showing the shovel PS. Furthermore, in the numerical value information image 474, the height of the end of the bucket 6 from the target surface (the vertical distance between the end of the bucket 6 and the target surface, which is 0.23 m in the illustration of FIG. 8) is displayed together with an icon showing the positional relationship with the target surface.

Furthermore, in the first target surface display image 472 and the second target surface display image 473, the bucket icon 475 is displayed in a shape that is an exaggeration of the actual shape of the bucket 6. Furthermore, the target surface 476 is displayed with an inclination angle that is greater than actually is. As a result of thus displaying the actual relationship between the bucket 6 and the target surface in an exaggerated manner, it becomes easier for the operator to check the positional relationship between the bucket 6 and the target surface during operations.

The same as in the setting screen 41A1, the setting date display part 480 displays the setting date information. In the illustration of FIG. 8, "yyyy/mm/dd 16:32" is displayed as a date and time, and "12300.0 hr" is displayed as the cumulative operating time of the engine 11. This makes it possible for the operator to recognize the date and time when the parameters of the bucket 6 were last set and the cumulative operating time of the engine 11.

The same as in the adjustment screen 41B1, the adjustment date display part 490 displays the adjustment date information. In the illustration of FIG. 8, "yyyy/mm/dd 16:32" is displayed as a date and time, and "12345.6 hr" is displayed as the cumulative operating time of the engine 11. This makes it possible for the operator to recognize the date and time when a parameter of the bucket 6 was last adjusted and the cumulative operating time of the engine 11.

Thus, on the guidance screen 41V1, the setting date information is displayed in the setting date display part 480, and the adjustment date information is displayed in the adjustment date display part 490. This makes it possible for the operator to recognize the date and time of the last setting of the parameters of the bucket 6, the date and time when a parameter of the bucket 6 was last adjusted, etc., by checking the guidance screen 41V1. Therefore, the operator can replace the bucket 6 and adjust a parameter of the bucket 6 at an appropriate time by comparing these dates and times, etc., and a current date and time, etc.

Information displayed in the above-described rotational speed mode display part 452, traveling mode display part 453, attachment display part 454, engine control status display part 455, and image capturing unit icon 461 is "information pertaining to the settings of the shovel PS. Information displayed in the remaining aqueous urea solution amount display part 456, the remaining fuel amount display part 457, the coolant water temperature display part 458, and the engine operating time display part 459 is "information pertaining to the operating condition of the shovel PS."

In addition to those described above, the guidance screen 41V1 may include a fuel efficiency display part to display fuel efficiency, a hydraulic oil temperature display part to display the temperature condition of hydraulic oil in a hydraulic oil tank, and an alarm display part to display information indicating the necessity of adjustment of a parameter of the bucket 6. The alarm display part displays information indicating the necessity of adjustment of a parameter of the bucket 6 when a predetermined time has passed since the adjustment of a parameter of the bucket 6. This makes it possible to prevent the operator from performing work such as excavation without adjusting a parameter of the bucket 6 when it is necessary to adjust the parameter of the bucket 6.

Furthermore, the remaining aqueous urea solution amount display part 456, the remaining fuel amount display part 457, and the coolant water temperature display part 458, which are displayed in a bar graph in the illustration of FIG. 8, may alternatively be of needle display, and the form of display of the areas is not limited to what illustrated in this embodiment. Furthermore, the area layout is not limited to the configurations illustrated in this embodiment.

Figure 9:
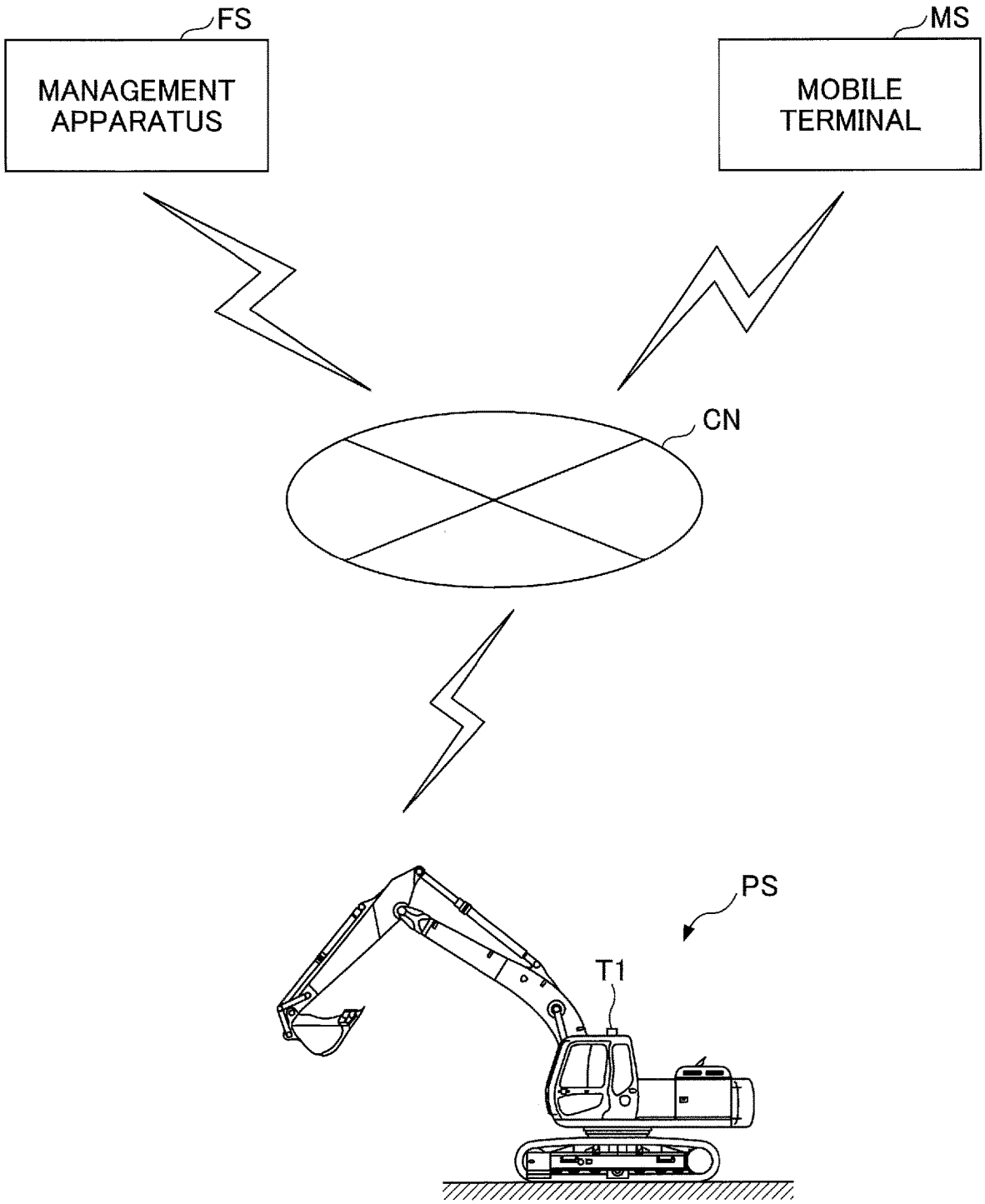
FIG. 9 is a diagram illustrating an example of a shovel management system according to the embodiment.

Next, a shovel management system that manages the shovel PS is described. FIG. 9 is a diagram illustrating an example of the shovel management system according to the embodiment.

As illustrated in FIG. 9, the shovel management system includes the shovel PS, the management apparatus FS, and the mobile terminal MS. The shovel PS, the management apparatus FS, and the mobile terminal MS operate as communications terminals interconnected via a communications network CN. Each of the shovel PS, the management apparatus FS, and the mobile terminal MS that constitute the shovel management system may be one or more in number. In the illustration of FIG. 9, the shovel management system includes the single shovel PS, the single management apparatus FS, and the single mobile terminal MS.

The shovel PS includes the transmitter T1. The transmitter T1 transmits information to the outside of the shovel PS. The transmitter T1 transmits, for example, information that can be received by at least one of the management apparatus FS and the mobile terminal MS.

The management apparatus FS is an apparatus that manages the work of the shovel PS, and is, for example, a computer installed in a management center outside a work site. The management apparatus FS may be a portable computer that can be carried by a user.

The mobile terminal MS includes a smartphone, a tablet terminal, and a notebook personal computer.

Figure 10:
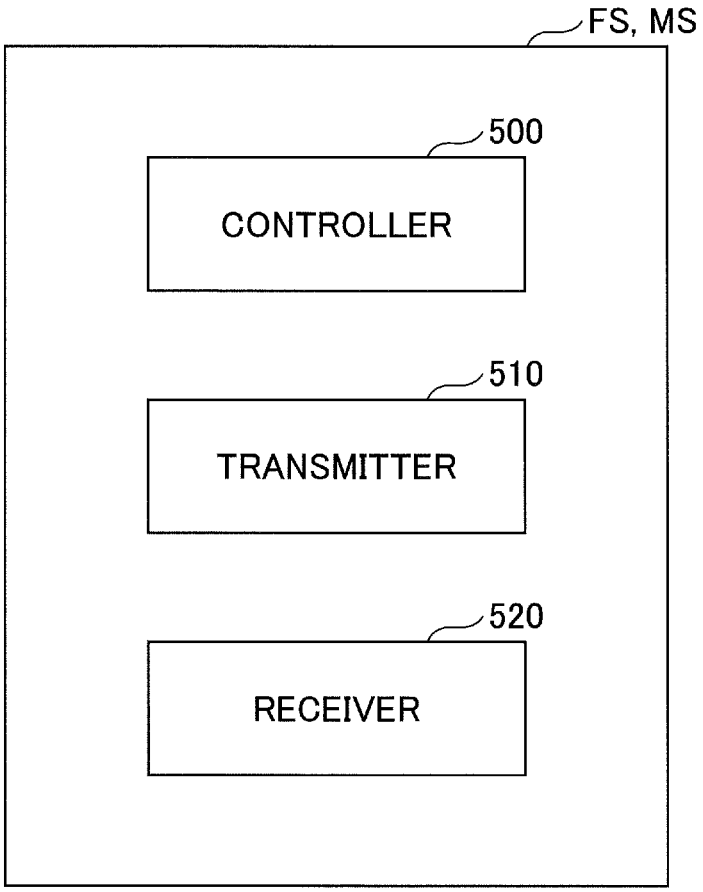
FIG. 10 is a schematic diagram illustrating a configuration of each of a management apparatus and a mobile terminal according to the embodiment.

FIG. 10 is a schematic diagram illustrating a configuration of each of the management apparatus FS and the mobile terminal MS. Referring to FIG. 10, each of the management apparatus FS and the mobile terminal MS includes a controller 500, a transmitter 510, and a receiver 520. The controller 500 operates as a main control part that controls the operation of the entire management apparatus FS or mobile terminal MS. Like the controller 30, the controller 500 is composed of a processing unit including a CPU and an internal memory. The CPU executes a program stored in the internal memory to implement various functions of the controller 500. The transmitter 510 transmits information to the outside of the management apparatus FS or the mobile terminal MS. The receiver 520 receives information transmitted to the management apparatus FS or the mobile terminal MS.

According to the shovel management system, when the parameters of the bucket 6 including a type and a size are set in the shovel PS, the transmitter T1 of the shovel PS transmits the setting date information to at least one of the management apparatus FS and the mobile terminal MS via the communications network CN. The receiver 520 of the at least one of the management apparatus FS and the mobile terminal MS receives the transmitted setting date information. This makes it possible for a manager or the like of the shovel PS to check the setting date of the type, size, etc., of the bucket 6, using at least one of the management apparatus FS and the mobile terminal MS, and thus to perform process control in view of the timing of replacement of the bucket 6.

Furthermore, according to the shovel management system, when a parameter of the bucket 6 is adjusted in the shovel PS, the transmitter T1 of the shovel PS transmits the adjustment date information to at least one of the management apparatus FS and the mobile terminal MS via the communications network CN. The receiver 520 of the at least one of the management apparatus FS and the mobile terminal MS receives the transmitted adjustment date information. This makes it possible for a manager or the like of the shovel PS to check the adjustment date of a parameter of the bucket 6, using at least one of the management apparatus FS and the mobile terminal MS, and thus to perform process control in view of the timing of adjustment of a parameter of the bucket 6.

As described above, according to the shovel PS of this embodiment, time information at the time of the last adjustment of information on the bucket 6 is displayed in the image display part 41 of the display device 40. This makes it possible for the operator to easily understand the time to adjust a parameter of the bucket 6 and thus to adjust the parameter of the bucket 6 at an appropriate time. Therefore, the operator can accurately perform work even when a tooth of the bucket 6 is worn.

Furthermore, according to the shovel PS of this embodiment, time information at the time of the last setting of information on the bucket 6 is displayed in the image display part 41 of the display device 40. This makes it possible for the operator to easily understand the time to replace the bucket 6 and thus to replace the bucket 6 at an appropriate time.

A shovel according to an embodiment is described above. The present invention, however, is not limited to the above-described embodiment, and variations and modifications may be made without departing from the scope of the present invention.

The above embodiment is described, taking, as a non-limiting example, the case where time information at the time when the parameters of the bucket 6 are set is the setting date information and time information at the time when a parameter of the bucket 6 is adjusted is the adjustment date information. Alternatively, it is also possible to, for example, determine time information at the time when the parameters of the bucket 6 are set and time information at the time when a parameter of the bucket 6 is adjusted as the adjustment date information without distinguishing between the setting date information and the adjustment date information.

What is claimed is:

1. A shovel comprising:

a lower traveling body;

an upper turning body turnably mounted on the lower traveling body;

a cab mounted on the upper turning body;

an attachment attached to the upper turning body and including a working part configured to perform work at an end of the attachment; and a display device provided in the cab, wherein the display device is configured to simultaneously display a value of a parameter of the working part, the parameter being a target of adjustment, and time information at a time of a last adjustment of the parameter of the working part.

2. The shovel as claimed in claim 1, wherein the time information at the time of the last adjustment of the parameter of the working part is information including at least one of a date and time, a cumulative operating time of an engine, a cumulative usage time of the working part, and a cumulative operating time of the attachment.

3. The shovel as claimed in claim 1, wherein the display device is configured to display the time information at the time of the last adjustment of the parameter of the working part when an adjustment screen for adjusting the parameter of the working part is displayed.

4. The shovel as claimed in claim 1, wherein the display device is configured to further display information indicating a necessity of an adjustment of the working part, in response to a passage of a predetermined time since the last adjustment of the working part.

5. The shovel as claimed in claim 1, wherein the display device is configured to further display time information at a time of a last setting of the parameter of the working part.

6. The shovel as claimed in claim 5, wherein the display device is configured to display the time information at the time of the last setting of the parameter of the working part when a setting screen for setting the parameter of the working part is displayed.

7. The shovel as claimed in claim 1, wherein a value related to a length of an end attachment is displayed together with an image representing the end attachment on the display device, the image including an arm top pin position, a bucket link pin position, and the working part.

8. The shovel as claimed in claim 1, wherein a length of a line segment connecting an end position of the working part and an attachment position of the working part is displayed on the display device.

9. The shovel as claimed in claim 1, wherein a type of an end attachment including the working part is displayed on the display device.

10. A method of displaying information of a working part of an attachment of a shovel, the attachment including the working part at an end of the attachment, the method comprising:

causing a value of a parameter of the working part, the parameter being a target of adjustment, and time information at a time of a last adjustment of the parameter of the working part to be simultaneously displayed on a display device of the shovel.

11. The method as claimed in claim 10, wherein the time information at the time of the last adjustment of the parameter of the working part is displayed on the display device when an adjustment screen for adjusting the parameter of the working part is displayed on the display device.

12. The method as claimed in claim 10, wherein a value related to a length of an end attachment is displayed together with an image representing the end attachment on the display device, the image including an arm top pin position, a bucket link pin position, and the working part.

13. The method as claimed in claim 10, wherein a length of a line segment connecting an end position of the working part and an attachment position of the working part is displayed on the display device.

14. A mobile terminal connected to a shovel through a communications network, comprising:

a receiver configured to simultaneously receive a value of a parameter of a working part of the shovel, the parameter being a target of adjustment, and time information at a time of a last adjustment of the parameter of the working part, the value and the time information being transmitted from the shovel.

15. The mobile terminal as claimed in claim 14, wherein the parameter includes a length of a line segment connecting an end position of the working part and an attachment position of the working part.

16. A shovel comprising:

a lower traveling body;

an upper turning body turnably mounted on the lower traveling body;

a cab mounted on the upper turning body;

an attachment attached to the upper turning body and including a working part configured to perform work at an end of the attachment;

a posture sensor attached to the attachment;

a hardware processor configured to calculate a position of the working part based on a detection value of the posture sensor and set information of the working part; and a display device provided in the cab, wherein the display device is configured to display time information at a time of a last adjustment of the set information of the working part.

* * * * *